US005938276A

United States Patent [19]

Munoz et al.

[11] Patent Number: 5,938,276

[45] Date of Patent: Aug. 17, 1999

[54] PORTABLE SEAT FOR A PAIL

[75] Inventors: Jose C Munoz, Pico Rivera; John P Behm, Petaluma, both of Calif.

[73] Assignee: McGuire-Nicholas Company, Inc., City of Commerce, Calif.

[21] Appl. No.: 08/645,837

[22] Filed: May 14, 1996

[51] Int. Cl.[6] ..... A47C 7/62

[52] U.S. Cl. ..... 297/188.12; 297/188.08

[58] Field of Search ..... 297/195.11, 188.01, 297/188.08, 188.09, 188.12, 188.2, 217.1, 463.2; 4/483; 248/213.2; 108/14, 42, 159

[56] References Cited

U.S. PATENT DOCUMENTS

| | | | |
|---|---|---|---|
| 2,919,169 | 12/1959 | Jackson | 297/188.09 X |
| 2,928,270 | 3/1960 | Olson | 248/213.2 X |
| 3,751,845 | 8/1973 | Van Leeuwen | 297/188.09 X |
| 4,295,680 | 10/1981 | Grasso | 297/188.09 |
| 4,379,587 | 4/1983 | Duncan | 297/188.12 X |
| 4,436,340 | 3/1984 | Hernandez | 297/188.09 |
| 4,846,076 | 7/1989 | Menges, Sr. et al. | 297/188.09 X |
| 4,907,840 | 3/1990 | Hawkins | 297/188.09 |
| 5,033,704 | 7/1991 | Kerr | 248/213.2 X |
| 5,170,516 | 12/1992 | Davison | 297/188.09 X |

*Primary Examiner*—Milton Nelson, Jr.
*Attorney, Agent, or Firm*—Denton L. Anderson; Sheldon & Mak, Inc.

[57] ABSTRACT

A seat for a substantially cylindrically-shaped pail having a pail opening, a pail lip adjacent the opening, and a hollow compartment inside the pail is disclosed. The seat comprises a platform for seating a person when the seat is mounted on the pail and grooves formed by walls on opposite sides of the platform. The grooves fit on the pail lip when the seat is in use. The seat has a width substantially less than a diameter of the pail opening so that a person seated on the platform can reach between the platform and the pail lip to remove or insert hand tools. The seat also fits into the pail when not in use. The seat has ribs on its bottom side for strengthening purposes.

14 Claims, 1 Drawing Sheet

PORTABLE SEAT FOR A PAIL

FIELD OF THE INVENTION

The present invention relates to portable seats that can be mounted on a pail.

BACKGROUND

It is often difficult to find a chair or other seating place at sites where building construction or maintenance is occurring. However, construction or maintenance workers, such as painters, often carry a large, sturdy pail along with them to carry tools and other items.

A portable seat which fits such a pail and is sturdy enough to provide support for a person has been previously constructed. The seat covers the entire opening of the pail and has a ridge which fits against the inside of the pail's lip around the entire circumference of the lip. While this prior art seat provides a place for a person to sit, it can be easily misplaced and must be removed from the pail to access the hollow compartment inside the pail.

Therefore, there is a need for a seat that can be mounted on a pail which:

(1) is not easily misplaced;

(2) allows access to the hollow compartment inside the pail without requiring removal of the seat from the pail;

(3) is portable;

(4) is inexpensive to manufacture; and (5) is lightweight.

SUMMARY

The present invention meets these needs.

The present invention is directed to a portable seat for a substantially cylindrically-shaped pail which has a pail opening, a lip adjacent the opening, and a hollow compartment inside of the pail. A seat having features of the present invention includes a platform for seating a person when the seat is mounted on the pail, outside first and second groove walls on opposite sides of the platform, as well as inside first and second groove walls near the outside first and second groove walls. The outside and inside groove walls form grooves on each side of the seat for fitting over the pail lip when the seat is mounted on the pail.

The seat has a width which is substantially less than a diameter of the opening in the pail so that when the seat is mounted on the pail, a person seated on the top side of the platform can reach between the front side of the platform and the pail lip to remove hand tools from the hollow compartment inside the pail or to store hand tools therein. The width of the seat also allows the seat to be placed inside the pail when it is not in use.

The front and back side walls can be concave thereby creating an hour glass shape for the seat. The hour glass shape makes the seat more comfortable to sit on and yet provides better access to the hollow compartment inside the pail.

Ribs can be provided on a bottom side of the platform to provide structural strength while minimizing the amount of material necessary to provide adequate seat support.

BRIEF DESCRIPTION OF DRAWINGS

These and other features, aspects, and advantages of the present invention will become understood with regard to the following description, appended claims and accompanying drawings where:

DESCRIPTION

Figure 1:
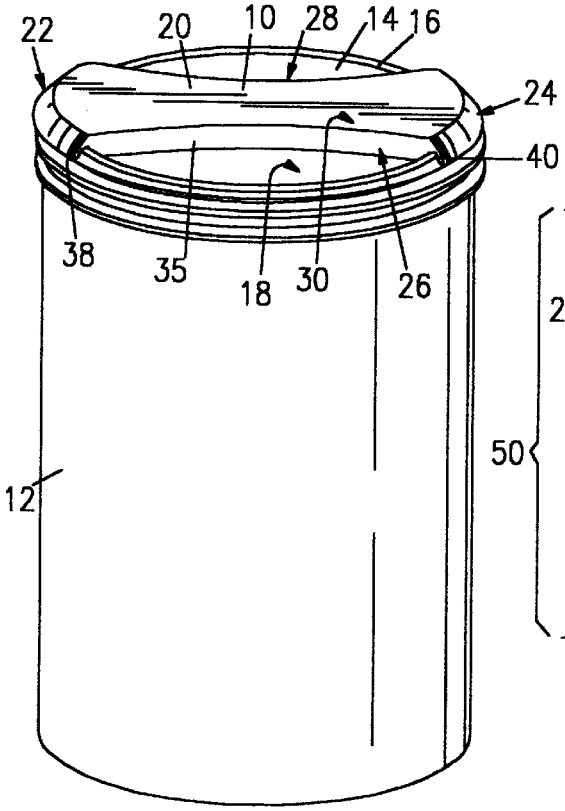
FIG. 1 is a perspective view of a portable seat according to the present invention mounted on a substantially-cylindrical pail.
Figure 2:
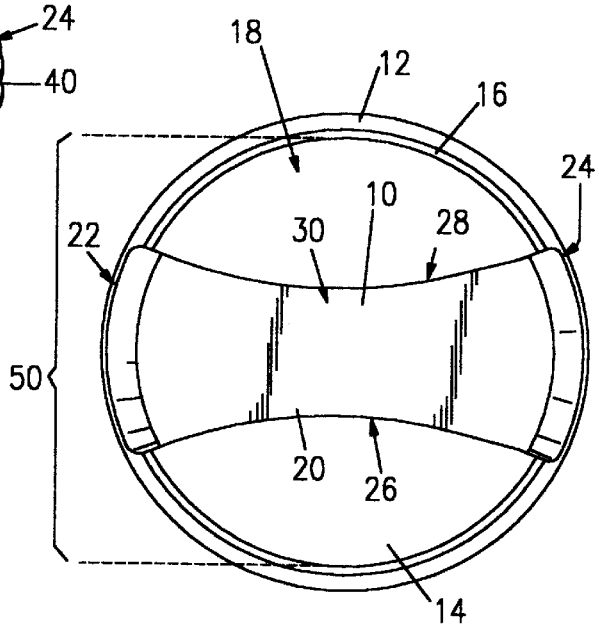
FIG. 2 is a top view of the portable seat and pail of FIG. 1.

As shown in FIGS. 1 and 2, a seat 10 is mounted on a substantially cylindrically-shaped pail 12. The pail 12 has a pail opening 14, a pail lip 16 adjacent the opening 14, and a hollow compartment 18 inside the pail 12.

Figure 3:
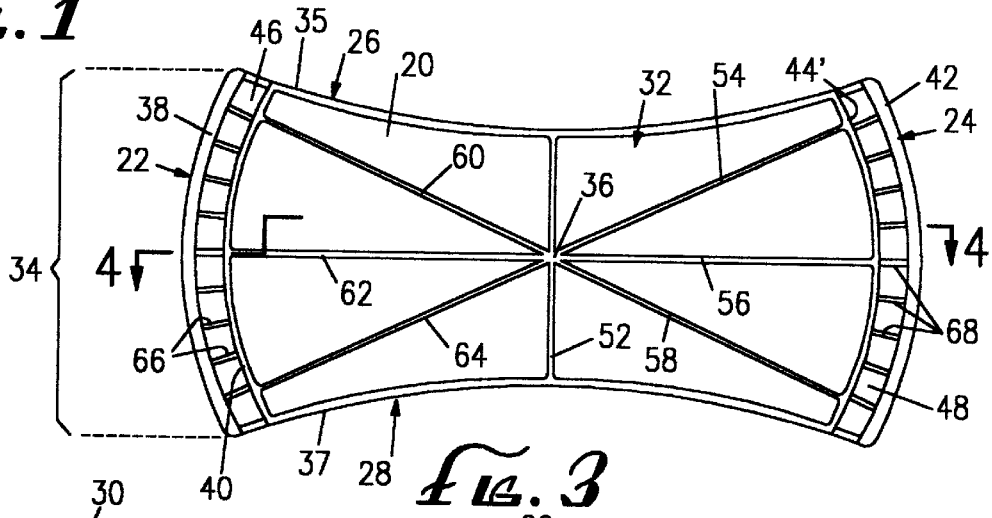
FIG. 3 is a bottom view of the portable seat of FIG. 1.

The seat 10 has a platform 20 for seating a person when the seat 10 is mounted on the pail 12, as shown in FIGS. 1 and 2. The platform 20 has a first mounting side 22, a second mounting side 24, a front side 26, a back side 28, a top side 30, and a bottom side 32. The bottom side 32 of the platform 20 is best illustrated in FIG. 3. The platform 20 also has a width 34 as measured from the front side 26 to the back side 28. The width 34 varies from its greatest distance near the first and second mounting sides 22 and 24 to its least distance along the center 36 of the bottom side 32 of the platform 20. The platform 20 also has a front side wall 35 and a back side wall 37 along the front and back sides 27 and 28, respectively.

Figure 4:
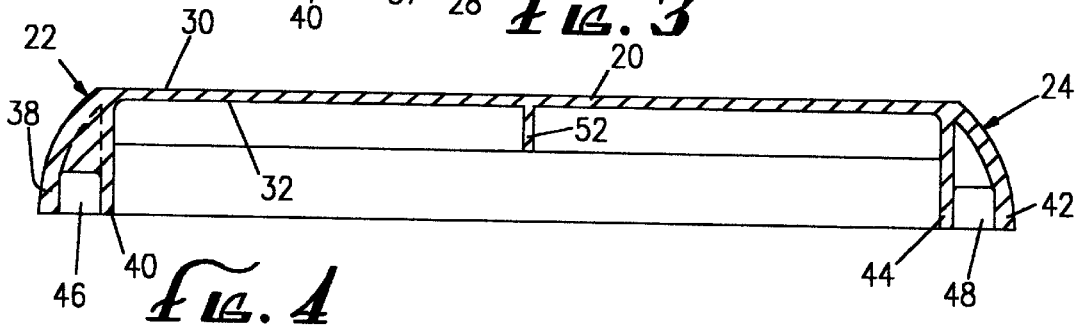
FIG. 4 is a cross-sectional side view of a portion of the portable seat taken along line 4—4 of FIG. 3.

The platform 20 further has an outside first groove wall 38, an inside first groove wall 40, an outside second groove wall 42 and an inside second groove wall 44. The outside first and second groove walls 38 and 42 are adjacent the first and second mounting sides 22 and 24, respectively. When the seat 10 is mounted on the pail 12, as shown in FIGS. 2 and 3, the outside first and second groove walls 38 and 42 extend outside and adjacent the pail lip 16. The groove walls are best illustrated in FIGS. 3 and 4.

As shown in FIG. 3, the inside first and second groove walls 40 and 44 extend downwardly from the bottom side 32 of the platform 20. These inside first and second groove walls 40 and 44 extend inside the pail lip 16 when the seat 10 is installed on the pail 20. The outside first and second groove walls 38 and 42 and the inside first and second groove walls 40 and 44, respectively, form a first groove 46 and a second groove 48, respectively. When the seat 10 is mounted on the pail 12, the first and second grooves 46 and 48 fit over the pail lip 16.

If it is desired to have a seat 10 that can be rotated on the pail 12 while a person is sitting on the seat 10, the first and second grooves 46 and 48 should be wider than the pail lip 16 by about ¼ inch. On the other hand, if it is more desirable to maintain the seat 10 in a single position on the pail 12 (unless the seat 10 is first dismounted from the pail 12), the width of the first and second grooves 46 and 48 should be about the same as the width of the pail lip 16 so that the first and second grooves 46 and 48 fit snugly on the pail lip 16.

The width 34 of the platform 20 should be substantially less than a diameter 50 of the pail lip 16. For example, when the pail opening has a diameter of about $11_{1/4}$ inches, the platform 20 can have a width of about 4 inches along the center 36 of the platform 20 and a width of about 6 inches near the first and second mounting sides 22 and 24. Because the diameter 50 of the pail lip 16 is substantially greater than the width of the platform 20, especially near the center 36, a person seated on the top side 30 of the platform 20 can reach between the front side 26 or the back side 28 of the platform 20 and the pail lip 16 to remove hand tools from the hollow compartment 18, or to store such tools in the hollow compartment 18. Such dimensions also allow the seat 10 to be placed lengthwise through the pail opening 14 and into the hollow compartment 18 when the seat 10 is dismounted from the pail. The seat 10 can have a length of about 12.5 inches and the typical hollow compartment 18 is about 15 inches deep.

In the drawings, the front side wall 35 and the back side wall 37 are concave thereby forming an hour glass-like shape of the platform 20. This shape allows a greater surface area of contact between the first and second grooves 46 and 48 of the seat 10 and the pail lip 14 when the seat 10 is mounted on the pail 12, while also providing a greater access through the pail opening 14 for a person sitting on the seat 10. The greater width near the first and second mounting sides 22 and 24 of the platform 20 also provides a more comfortable fit for a person sitting on the seat 10.

The platform 20 has a plurality of ribs to strengthen the platform 20 when it is in use. A cross rib 52 extends downwardly from the bottom side 32 of the platform 20 between the front side wall 35 and the back side wall 37. The cross rib 52 can have a thickness of about 3/32 inch.

The seat 10 also has a plurality of radial ribs that extend out from substantially the center 36 of the bottom side 32. First, second and third right radial ribs 54, 56 and 58, respectively, extend from the center 36 to the inside second groove wall 44. First, second and third left radial ribs 60, 62 and 64, respectively, extend substantially from the center 36 to the inside first groove wall 40. Each of the radial ribs can have a thickness of about 1/8 inch.

The seat 10 can further have a plurality of first and second lateral ribs 66 and 68, respectively, for strengthening the area of the seat 10 near the first and second groves 46 and 48, respectively.

The seat 10 can be made of hard plastic such as polypropylene available from a variety of companies, including Dow Chemical. Other hard, sturdy materials can be used. The seat can be injection molded or can be carved or machined out of a block of hard material.

Use of the seat 10 is simple and easy. The first and second grooves 46 and 48 of the seat 10 are placed over the pail lip 16. The person can then sit on the seat 10 and reach between the front side wall 35 and the pail lip 16 to remove or insert tools in the pail. Alternatively, a person can reach between the back side wall 37 and the pail lip 16 to remove or insert tools. The seat 10 is easily dismounted from the pail lip 16 and can then be stored in the pail 12 by inserting it through the pail opening 14.

Although the present invention has been described in considerable detail with reference to certain preferred versions thereof, other versions are possible. Therefore, the spirit and scope of the appended claims should not be limited to the description of the preferred versions contained herein.

What is claimed is:

1. A portable seat for a substantially cylindrically-shaped pail, the pail including a pail opening with a diameter, a pail lip adjacent the opening, and a hollow compartment inside the pail, the seat comprising:

(a) a platform for seating a person when the seat is mounted on the pail, the platform having a first mounting side, a second mounting side, a front side, a back side, a top side, a bottom side and a width measured from the front side to the back side;

(b) an outside first groove wall adjacent the first mounting side of the platform, the outside first groove wall extending outside and adjacent the pail lip when the seat is mounted on the pail;

(c) an inside first groove wall extending downwardly from the bottom side of the platform, the inside first groove wall extending inside the pail lip when the seat is installed on the pail, the outside first groove wall and the inside first groove wall forming a first groove for fitting over the pail lip when the seat is mounted on the pail;

(d) an outside second groove wall adjacent the second mounting side of the platform, the outside second groove wall extending outside and adjacent the pail lip when the seat is mounted on the pail;

(e) an inside second groove wall extending downwardly from the bottom side of the platform, the inside second groove wall extending inside the pail lip when the seat is mounted on the pail, the outside second groove wall and the inside second groove wall forming a second groove for fitting over the pail lip when the seat is mounted on the pail;

the width of the platform being substantially less than the diameter of the pail opening so that: (1) when the seat is mounted on the pail, a person seated on the top side of the platform can reach between the front side of the platform and the pail lip to remove and store hand tools from and in, respectively, the hollow compartment; and (2) when a person is no longer seated on the seat, the seat can be dismounted from the pail lip and placed lengthwise through the opening into the pail.

2. The seat of claim 1 wherein the width of the platform is sufficiently narrow with respect to the diameter of the pail so that, when the platform is disposed on the pail, an opening is defined between the back side of the platform and the lip of the pail of sufficient size that a person seated on the seat can reach between the back side of the platform and the pail lip to remove and store hand tools from and in, respectively, the hollow compartment.

3. The seat of claim 1 further comprising a concave front side wall connected to and extending downwardly from the front side of the platform and a concave back side wall connected to and extending downwardly from the back side of the platform.

4. The seat of claim 3 further comprising a cross rib extending downwardly from the bottom side of the platform between the front side wall and the back side wall.

5. The seat of claim 1 further comprising a plurality of radial ribs attached to the bottom side of the platform and extending radially from substantially a center of the platform to the inside first and second groove walls.

6. The seat of claim 1 further comprising a cross rib extending from the front side to the back side of the platform substantially through the center of the bottom side of the platform.

7. The seat of claim 6 further comprising a plurality of lateral ribs extending between the outside first and second groove walls and the inside first and second groove walls, respectively.

8. A portable seat for a substantially cylindrically-shaped pail, the pail including a pail opening with a diameter, a pail lip adjacent the opening, and a hollow compartment inside the pail, the seat comprising:

(a) a platform for seating a person when the seat is mounted on the pail, the platform having a first mounting side, a second mounting side, a front side, a back side, a top side, a bottom side and a width measured from the front side to the back side;

(b) an outside first groove wall adjacent the first mounting side of the platform, the outside first groove wall extending outside and adjacent the pail lip when the seat is mounted on the pail;

(c) an inside first groove wall extending downwardly from the bottom side of the platform, the inside first groove wall extending inside the pail lip when the seat is installed on the pail, the outside first groove wall and the inside first groove wall forming a first groove for fitting over the pail lip when the seat is mounted on the pail;

(d) an outside second groove wall adjacent the second mounting side of the platform, the outside second groove wall extending outside and adjacent the pail lip when the seat is mounted on the pail;

(e) an inside second groove wall extending downwardly from the bottom side of the platform, the inside second groove wall extending inside the pail lip when the seat is mounted on the pail, the outside second groove wall and the inside second groove wall forming a second groove for fitting over the pail lip when the seat is mounted on the pail;

(f) a concave front side wall connected to and extending downwardly from the front side of the platform;

the width of the platform being substantially less than the diameter of the pail opening so that: (1) when the seat is mounted on the pail, a person seated on the top side of the platform can reach between the front side of the platform and the pail lip to remove and store hand tools from and in, respectively, the hollow compartment; and (2) when a person is no longer seated on the seat, the seat can be dismounted from the pail lip and placed lengthwise through the opening into the pail.

9. The seat of claim 8 wherein the width of the platform is sufficiently narrow with respect to the diameter of the pail so that, when the platform is disposed on the pail, an opening is defined between the back side of the platform and the lip of the pail of sufficient size that a person seated on the seat can reach between the back side of the platform and the pail lip to remove and store hand tools from and in, respectively, the hollow compartment.

10. The seat of claim 9 further comprising a concave back side wall connected to and extending downwardly from the back side of the platform.

11. The seat of claim 9 further comprising:

(g) a plurality of radial ribs attached to the bottom side of the platform and extending radially from substantially a center of the platform to the inside first and second groove walls;

(h) a cross rib extending from the front side to the back side of the platform substantially through the center of the bottom side of the platform; and (i) a plurality of lateral ribs extending between the outside first and second groove walls and the inside first and second groove walls, respectively.

12. A portable seat for a substantially cylindrically-shaped pail, the pail including a pail opening with a diameter, a pail lip adjacent the opening, and a hollow compartment inside the pail, the seat comprising:

(a) a platform for seating a person when the seat is mounted on the pail, the platform having a first mounting side, a second mounting side, a front side, a back side, a top side, a bottom side and a width measured from the front side to the back side;

(b) an outside first groove wall adjacent the first mounting side of the platform, the outside first groove wall extending outside and adjacent the pail lip when the seat is mounted on the pail;

(c) an inside first groove wall extending downwardly from the bottom side of the platform, the inside first groove wall extending inside the pail lip when the seat is installed on the pail, the outside first groove wall and the inside first groove wall forming a first groove for fitting over the pail lip when the seat is mounted on the pail;

(d) an outside second groove wall adjacent the second mounting side of the platform, the outside second groove wall extending outside and adjacent the pail lip when the seat is mounted on the pail;

(e) an inside second groove wall extending downwardly from the bottom side of the platform; the inside second groove wall extending inside the pail lip when the seat is mounted on the pail, the outside second groove wall and the inside second groove wall forming a second groove for fitting over the pail lip when the seat is mounted on the pail;

(f) a concave front side wall connected to and extending downwardly from the front side of the platform;

(g) a concave back side wall connected to and extending downwardly from the back side of the platform; and (h) a plurality of ribs attached to the bottom side of the platform for strengthening the seat;

the width of the platform being substantially less than the diameter of the pail opening so that: (1) when the seat is mounted on the pail, a person seated on the top side of the platform can reach between the front side of the platform and the pail lip, and between the back side of the platform and the pail lip, to remove and store hand tools from and in, respectively, the hollow compartment; and (2) when a person is no longer seated on the seat, the seat can be dismounted from the pail lip and placed lengthwise through the opening into the pail.

13. The seat of claim 12 wherein the plurality of ribs includes: (i) a plurality of radial ribs attached to the bottom side of the platform and extending radially from substantially the center of the platform to the inside first and second groove walls; and (ii) a cross rib extending downwardly from the bottom side of the platform between the front side wall and the back side wall.

14. The seat of claim 12 further comprising a plurality of lateral ribs extending between the outside first and second groove walls and the inside first and second groove walls, respectively.

* * * * *